United States Patent [19]

Vanden Bergh

[11] 4,342,614

[45] Aug. 3, 1982

[54] PRESSURE APPLICATOR FOR GRAPHIC TRANSFER

[75] Inventor: Jan D. Vanden Bergh, Afton, Minn.

[73] Assignee: Minnesota Mining and Manufacturing Company, St. Paul, Minn.

[21] Appl. No.: 240,210

[22] Filed: Mar. 3, 1981

[51] Int. Cl.[3] ..... B44C 1/10; B44C 1/16

[52] U.S. Cl. ..... 156/541; 156/238; 156/574; 156/584

[58] Field of Search ..... 156/238, 249, 344, 523, 156/541, 574, 584, 579

[56] References Cited

U.S. PATENT DOCUMENTS

| | | | |
|---|---|---|---|
| 1,173,127 | 2/1916 | Smith | 156/584 |
| 2,569,140 | 9/1951 | Avery | 156/541 |
| 3,607,256 | 9/1971 | Biegen | 156/235 |
| 3,897,587 | 7/1975 | Molner | 428/409 |
| 3,907,628 | 9/1975 | Buske | 156/584 |
| 4,089,730 | 5/1978 | Mahn | 156/541 |
| 4,171,398 | 10/1979 | Hunt | 428/195 |
| 4,216,283 | 8/1980 | Cooper et al. | 430/126 |

*Primary Examiner*—Michael G. Wityshyn

*Attorney, Agent, or Firm*—Cruzan Alexander; Donald M. Sell; William L. Huebsch

[57] ABSTRACT

A hand held applicator for transferring pressure transferable graphic images from an accepting tape to a receptor surface. The applicator comprises a body having a bottom surface and a back surface intersecting the bottom surface to define a sharp separating edge, and a roller rotatably mounted on the front portion of the body with its axis of rotation in parallel alignment with the separating edge. The outer periphery of the roller projects out from the bottom surface so that as the applicator is pressed against an accepting tape, the roller and separating edge form a narrow band of pressure contact with the accepting tape. The body portion affords manual engagement to press and slide the applicator against an accepting tape having its imaged surface against a receptor surface with the roller leading the separating edge, so that pressure from the roller initiates release of the image material from the accepting tape, while the subsequent pressure from the separating edge, together with the motion of the accepting tape around the separating edge and away from the applicator complete the transfer of the images to the receptor surface.

3 Claims, 2 Drawing Figures

PRESSURE APPLICATOR FOR GRAPHIC TRANSFER

BACKGROUND OF THE INVENTION

This invention relates to hand held tools for transferring pressure transferable graphic images from an accepting tape to a receptor surface.

DESCRIPTION OF THE PRIOR ART

Pressure transferable images or "rub-on" artwork is known in the prior art. For example, U.S. patent application Ser. No. 148,452 describes a composite material including an accepting tape comprising a transparent receiving web and a transparent adhesive layer on which graphic images may be composed and then transferred to a receptor by positioning the graphic images adjacent the receptor surface and applying pressure against the opposite surface of the accepting tape by rubbing or burnishing. The pressure separates the graphics from the adhesive layer and receiving web, and adheres the graphics to the substrate.

Examples of tools in the prior art for rubbing the accepting tape to transfer the graphic images include a dull pencil, a ball point pen, or other instrument with a blunt edge. However, using known tools for pressure transferring graphic images requires repeated passes of the tool against the accepting tape and also causes some distortion of the image on the receptor.

SUMMARY OF THE INVENTION

The present invention provides a hand held applicator for transferring pressure transferable graphic images from an accepting tape to a receptor surface, which applicator is especially adapted for use to transfer graphic images formed via the method described in U.S. patent application Ser. No. 148,452, and transfers such images easily and with minimum distortion of the transferred image.

The applicator comprises a body affording manual engagement to press and slide the applicator against an accepting tape, the body having a bottom surface and a back surface intersecting the bottom surface to define a sharp separating edge. A roller is rotatably mounted on the front portion of the body, with the roller having its axis of rotation in parallel alignment with the separating edge. The outer periphery of the roller projects out from the bottom surface so that as the applicator is pressed against an accepting tape, the roller and separating edge each form a narrow band of pressure contact with the accepting tape.

In operation, the user presses and slides the applicator against the clear surface of an accepting tape having its imaged surface against a receptor surface with the roller leading the separating edge. The pressure from the roller initiates release of the graphics from the adhesive layer and receiving web, and maintains alignment of the accepting tape on the receptor. Subsequent pressure from the separating edge, together with the motion of the receiving web of the accepting tape around the separating edge and away from the applicator complete the transfer to the receptor surface.

DETAILED DESCRIPTION

Figure 1:
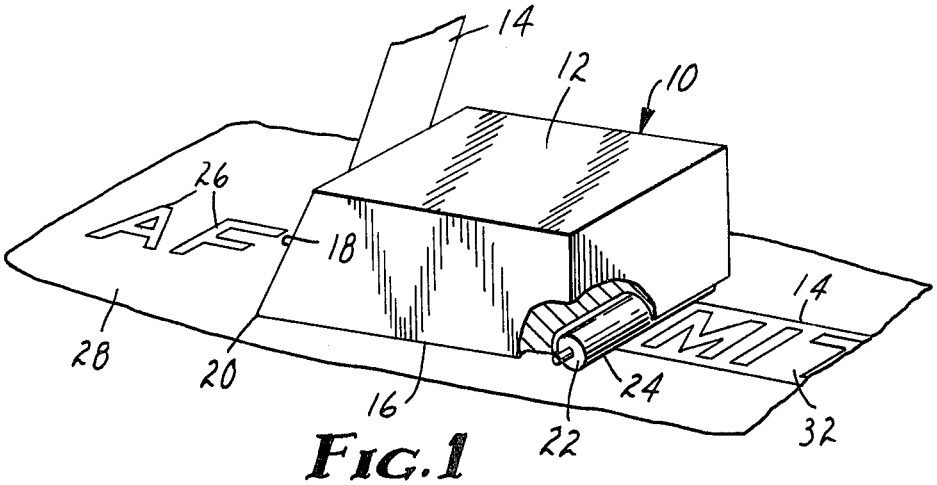
FIG. 1 is a perspective view of a hand held applicator according to the present invention having a part broken away to show details, and being used to transfer graphic images from an accepting tape to a receptor.
Figure 2:
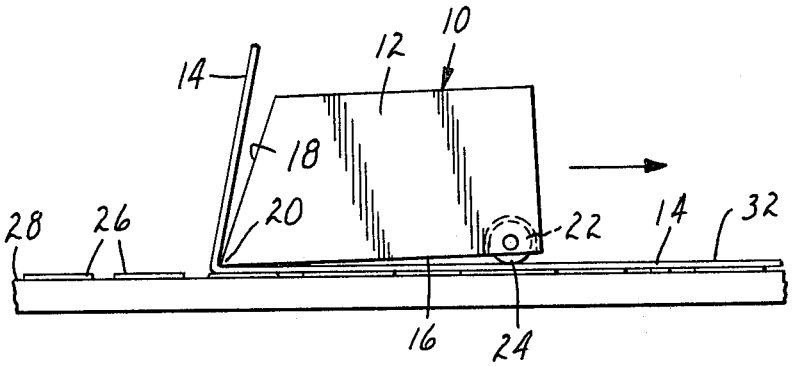
FIG. 2 is a side view of the applicator, graphic images, accepting tape, and receptor shown in FIG. 1.

Referring to the drawings there is illustrated a hand held applicator according to the present invention generally designated by reference numeral 10.

The applicator 10 includes a generally rectangular body 12 affording manual engagement to press and slide the applicator 10 on an accepting tape 14 which accepting tape 14 may have a plurality of pressure transferable images formed thereon in accordance with the teachings of U.S. patent application Ser. No. 148,452, the content whereof is incorporated herein by reference. The body 12 has a bottom surface 16 and a back surface 18 which intersects the bottom surface 16 to define a sharp separating edge 20. There is a roller 22 rotatably mounted on the front portion of body 12, which roller 22 is aligned with its axis of rotation parallel to the separating edge 20. The outer periphery 24 of the roller 22 projects out from the bottom surface 16, so that as the applicator is pressed against the accepting tape 14, the roller 22 and the separating edge 20 each form a line of pressure contact with the accepting tape 14.

In order to form a desired art display by applying the pressure transferable images 26 to a receptor surface 28, the accepting tape 14 is placed on the receptor surface 28 with the images 26 facing the receptor surface 28 and the clear surface 32 facing outward. The user grasps the applicator 10 and pushes the bottom surface 16 toward the clear surface 32. Since the outer periphery 24 of the roller 22 projects out from the bottom surface 16, the roller 22 and separating edge 20 each form a narrow band of pressure contact against the accepting tape 14. Then, the applicator 10 is slid over the accepting tape 14 with the roller 22 leading the separating edge 20, so that the pressure from the roller 22 initiates release of the image 26 and maintains alignment of the accepting tape 14. As the applicator 10 is pushed further, transfer of the image 26 is completed by the pressure from the separating edge 20, together with the motion of the accepting tape 14 around the separating edge 20 as the accepting tape 14 is pulled away from the applicator 10.

Preferably, the back surface 18 intersects the bottom surface 16 at an acute angle.

I claim:

1. A hand held applicator for transferring pressure transferable graphic images from an accepting tape to a receptor surface, the accepting tape having said pressure transferable images on one surface and having an opposite surface, the applicator comprising:

a body affording manual engagement to press and slide the applicator against said opposite surface of a said accepting tape, the body having a bottom surface and a back surface intersecting the bottom surface to define a sharp separating edge, and a roller rotatably mounted on the front portion of the body, the axis of rotation of the roller being in parallel alignment with the separating edge, and the outer periphery of the roller projecting out from the bottom surface, so that as the applicator is pressed against the accepting tape the roller and the separating edge each form a narrow band of pressure contact with the accepting tape, and as the applicator is slid, with the roller leading the separating edge, on said opposite surface of the accepting tape with its imaged surface engaging a receptor surface, the narrow band of pressure contact from the roller initiates release of the images and maintains alignment of the accepting tape, while the subsequent pressure contact at the separating edge, together with the motion of the accepting tape around the separating edge after the applicator has passed cause the graphic images to be transferred to the receptor surface.

2. An applicator according to claim 1, wherein the body is made from transparent materials.

3. An applicator according to claim 1, wherein the back surface intersects the bottom surface at an acute angle.

* * * * *